United States Patent [19]

Valantin

[11] 4,134,620

[45] Jan. 16, 1979

[54] CHANNELLING MACHINE FOR CUTTING A PRELIMINARY GROOVE AROUND THE WORKING FACE OF A TUNNEL

[75] Inventor: Alfred A. M. Valantin, Clermont, France

[73] Assignee: Sipremec, Nanterre, France

[21] Appl. No.: 853,837

[22] Filed: Nov. 22, 1977

[30] Foreign Application Priority Data

Nov. 26, 1976 [FR] France ..... 76 35718

[51] Int. Cl.[2] ..... E21D 9/08

[52] U.S. Cl. ..... 299/33; 299/15; 299/75

[58] Field of Search ..... 299/15, 31–33, 299/75

[56] References Cited

U.S. PATENT DOCUMENTS

| | | | |
|---|---|---|---|
| 3,325,217 | 6/1967 | Enz | 299/31 |
| 3,537,754 | 11/1970 | Valantin | 299/32 |
| 3,547,493 | 5/1969 | Starkle | 299/75 |

FOREIGN PATENT DOCUMENTS

| | | | |
|---|---|---|---|
| 2305583 | 3/1975 | France | 299/31 |
| 2252308 | 7/1973 | Fed. Rep. of Germany | 299/31 |

*Primary Examiner*—Ernest R. Purser

*Attorney, Agent, or Firm*—Charles E. Brown

[57] ABSTRACT

A channelling machine for cutting a preliminary groove around the working face of a tunnel being excavated. A guide and drive track assembly comprising at least two guide rails and a drive rail displaceable into the immediate proximity of the working face. The guide and drive track assembly is disposed entirely inside a hollow support frame of cross-section complementary to that of the tunnel being excavated. The guide and drive track assembly also includes a back-up rail likewise disposed inside the support frame. Another guide and drive track assembly may be provided symmetrical to the first. The machine is braced against the walls by a plurality of front and rear hydraulic cylinders which also adjust the alignment of the machine in the tunnel. The machine is mounted for displacements on a cradle.

12 Claims, 6 Drawing Figures

CHANNELLING MACHINE FOR CUTTING A PRELIMINARY GROOVE AROUND THE WORKING FACE OF A TUNNEL

The present invention relates to a channelling machine for cutting a preliminary groove along the periphery of working face which corresponds to the contour of the underground tunnel to be excavated. In such a machine a tool support is displaced by self-propelled means along a guide and drive track assembly extending continuously along the entire periphery of the ultimate tunnel, which guide and drive track assembly comprises at least two guide rails and a drive rail all of which may be displaced forward in an excavated part of a tunnel into immediate proximity of the working face.

French Pat. No. 666,516 published on Oct. 2, 1929 discloses a channelling machine for making such a cut or groove around the working face of a tunnel, comprising a guide rail configured so as to conform to a groove to be cut about the working face of the tunnel, a tool provided with rollers bearing against the inner and outer surfaces of the guide rail. The guide rail is carried "by a suitable structure, which may be behind lining rings shoring the part of the tunnel already dug." In this machine, there exists the possibility, amongst others, that the frame carrying the tool may carry a control motor which then operates so as to displace the frame by means of meshing teeth or a friction drive rail.

Since the foregoing patent, but rather recently, we have seen the development, in the field, of movable carriages with open arches, for displacing such machines, e.g. undercutters. Such machines which are generally driven by rack and pinion, mating with the contour of the arches, bear to counteract an overturning couple, against a peripheral rail outside the frame or on the outer forward face of the front of the frame shaped as a rail.

In machines such as that of the foregoing patent, in front of the protective shield which the frame provides there must be a gap for a part of the tool-carrying movable carriage, namely the rollers. Further, a gap must be left for these rollers between the frame and the walls of the already excavated tunnel.

It is a first object of the invention to recuperate the entire peripheral area, inside the central area defined by the frame in order to be able to work in smaller tunnels. Another object is to free the forward wall of the frame structure carrying the guide and drive track assembly for the benefit of propping the machine.

Another object of the invention is to move all the guiding and driving mechanism into a protected and easily inspected area.

Yet another object is to transfer all the forces inside the structure to obviate bending forces at the forward end.

Still yet another object is to be able to accurately adjust the alignment of the tool cutting the groove, which is not possible with known machines.

These objects are accomplished with a machine of the above described type embodying the present invention in that it comprises a hollow support frame the transverse section of which is complementary to the transverse contour of the tunnel to be excavated, that the guide and drive track assembly is entirely disposed inside the support frame and that it comprises, in addition, at least one back-up rail which is entirely disposed inside the support structure, proximate to the front thereof.

In this way the support structure may be braced in all directions, up to its forward extremity, throughout the working and displacement of the tool and its support on its continuous path of travel.

Of advantage, besides the guide and drive track assembly the support frame comprises, at the rear of the same, means for supporting and securing another guide and drive track assembly, at the inside, and preferably symmetrical with the first.

In the machine comprising a friction drive rail and in which the tool support is self-propelled by friction drive means, it is preferable for the friction drive means to be comprised of clamping jaws.

According to the present invention there is provided a machine comprising means for bracing against walls of the tunnel and means for adjusting the alignment in the tunnel preferably comprising at least three bracing hydraulic jacks which are individually adjustable.

Finally, according to machine embodying the present invention, there is preferably provided means for forward and reverse motion comprising a cradle displaceable forwardly and rearwardly on which the machine is installed for such forward and reverse displacement.

Other features and advantages will become apparent from the following description, given hereinafter merely by way of example, of a preferred embodiment of the invention.

For this purpose reference will be had to the accompanying drawings in which.

Figure 1:
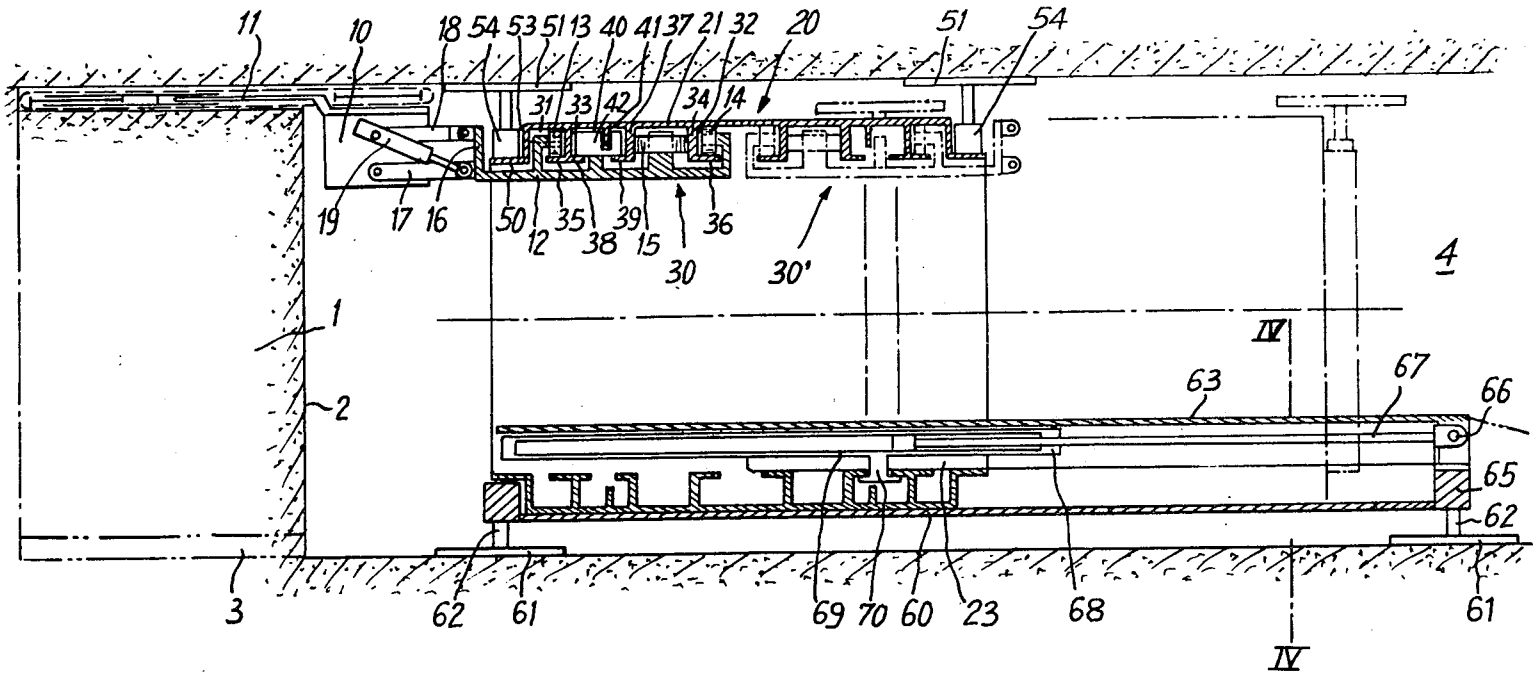
FIG. 1 is a longitudinal section of a channelling machine embodying the present invention.
Figure 2:
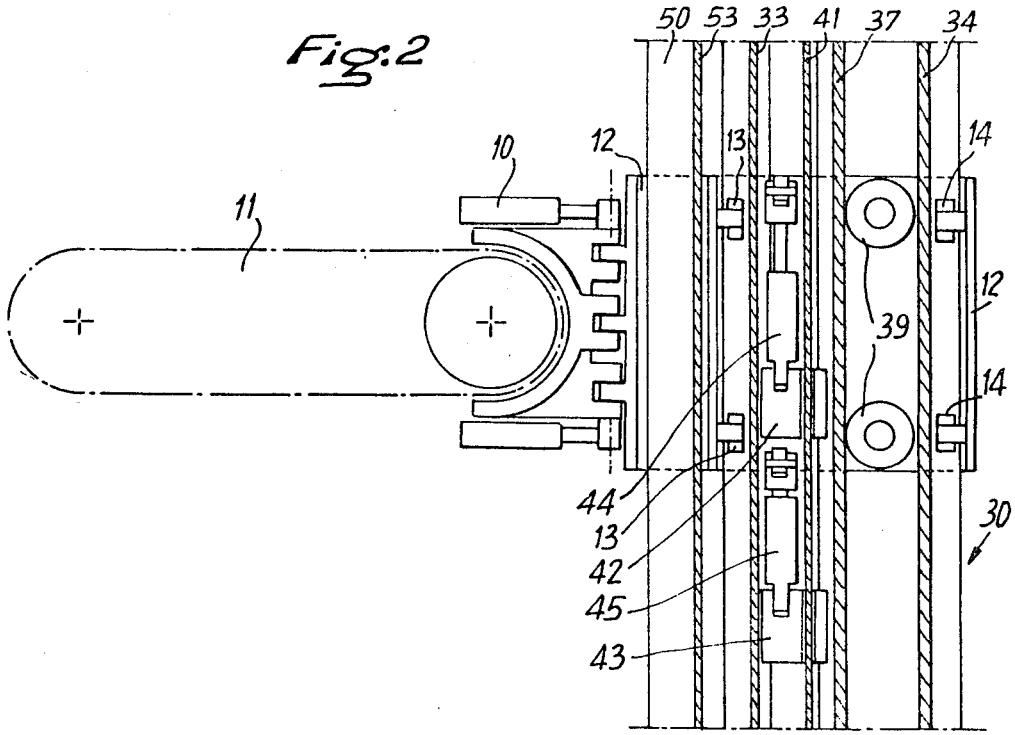
FIG. 2 is a peripheral sectional view of the guide and drive track assembly on which a tool and its support are diagrammatically illustrated.

The channelling machine illustrated is designed to trace an undercut or groove 3 parallel to the axis of the tunnel in a rock mass 1 by means of an arm 11 of an undercutter 10 carried by a support carriage 12, the working face being designated by numeral 2.

The machine comprises a support frame 20 having an outer surface complementary to that of the tunnel, i.e. cylindrical, of circular cross-section in FIGS. 1–4. The support frame 20 is hollow and therefore from the outside it appears as a cylindrical body. But the interior of the cylindrical body comprises a guide and drive track assembly designated overall by reference 30.

The guide and drive track assembly 30 comprises a plurality of rails or back-up rails for members adapted to the support carriage 12 of the undercutter.

The rails 31, 32 having annular angle irons 33, 34, the first and the last respectively, the first rail 31 being in the immediate vicinity of the front of the support frame 20, constitute inside the cylindrical shell, guiding rails facing the legs 35 and 36 of the annular angle irons 33 and 34. The legs 35 of the angle irons 33 and 34 are in opposite directions and serve as back-up rails for the rollers 13 and 14 carrying the support carriage 12.

An intermediate annular angle iron 37 defines with the angle iron 34 an intermediate longitudinal guiding rail for the rollers 15 of the support carriage 12, the axes of the rollers 15 being perpendicular to the support carriage and the cylindrical shell.

Another intermediate rail 40 is defined by the annular angle irons 33 and 37, optionally carrying legs. At the bottom of the rail 40, that is, inside the cylindrical shell is a friction drive rail 41 cooperable with a clamping device having two jaws 42, 43 for driving the support carriage 12 forwards pr backwards by means of two hydraulic cylinders 44, 45.

The double jawed clamping device which may be employed in the present machine has been described in French Pat. No. 1,548,671 and in French printed patent application No. 2,266,657.

The support carriage 12 comprises a front face 16 on which the undercutter is adjustably mounted in radical position with respect to the support frame 20 by means of two pivotally mounted, parallel arms 17, 18 and an obliquely oriented hydraulic jack 19.

It is seen from the description to this point that the objects of the invention are accomplished by the channelling machine embodying the present invention and that it is possible to provide a machine having an overall configuration similar to that of the tunnel to be excavated, from which the advantages of the invention are derived. It is also noted that the undercutter may be displaced by its own means along its support carriage 12 while being properly guided peripherally and longitudinally on the guide and drive track assembly 30.

It is possible to provide on the support frame other means for holding tools.

Of advangage, these other means are simply another guide and drive track assembly 30' symmetrical with the first.

The support structure 20 may be braced against the wakks if the tunnel or even against linings or facings installed before further forward movement, by means of at least three forward skids and at least three rear skids. The channelling machine here illustrated has four front and four rear skids.

At both front and rear of the annular support frame 20 there is provided a smaller diameter ring 50 so as to clear an annular space for accommodating the skid bracing means for bracing the support frame against the walls or lining of the tunnel and to align it.

Each of the skids 51 is hingedly mounted on a pivoted arm 52 about an axis parallel to the general axis of the tunnel on the front face 53 of the ring 50. A bracing hydraulic cylinder is associated with each skid 51 and pivotally mounted between the associated skid and the front face 53. By the selective extension and retraction of the front and rear skids, the alignment of the support frame 20 along the axis of the tunnel is easily achieved, thereby permitting either a straight or curved tunnel. The ultimate tightening of all eight skids guarantees excellent securement of the channelling machine.

The support frame 20 is carried by a cradle 60 the front inner end of which mates with the outer configuration of the cylindrical body wall of the support frame 20. The cradle itself is carried by skids 61 which are substantially identical to the skids 51 which likewise are mounted on pivoted arms 62 which, like the pivoted arms 52, may be braced tightly against the walls or lining by means of hydraulic cylinder 64. The cradle is, in addition, joined to the support structure 20 by its sides 70 which slide in longitudinal guideways 24 carried by the support frame 20.

Finally, the channelling machine comprising the support frame 20 and its cradle 60 may be braced against the walls or lining of the tunnel by means of six front and six rear skids.

The cradle 60 is longer than the cradle 20 which may be displaced longitudinally therealong. To this end, the cradle 60 has at the rear a vertical support member 65 for an anchoring mount 66 for the rod 67 by a member 70 fixed to one of the angle irons of the guide and drive track assembly 30' which is not used by the carriage 12.

Accordingly the cradle 60 held in the longitudinal guideways 24 may be moved forward by the hydraulic cylinder 58 by loosening it while maintaining the support frame 20 braced by its skids 51, after which it is sufficient, after pressurizing the skids 61, to loosen the skids 51 (the position of the skids in dash-dotted lines) and shove the support frame 20 ahead on the cradle 60 by means of the hydraulic cylinder 68. The adjustment of the alignment and the bracing of the assembly are thus facilitated.

It is convenient for the craddle 60 to carry a floor cantilevered from the support member 65. Yet the floor is not contilevered inside the support structure 20 because it is carried on a support member 22 of the cylinder body 69 of the hydraulic cylinder 68 which itself is carried on the guide and drive track assembly 30', which is not employed by the carriage 12, by means of a key or wedge 23.

The channelling machine embodying the invention has been described with reference to a cylindrical tunnel of circular cross-section.

Figure 5:
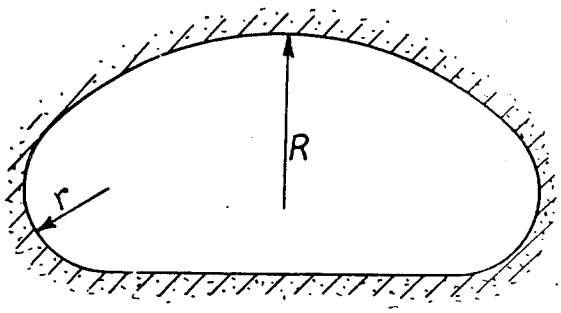
FIGS. 5 and 6 are two possible sections of tunnels which may be channelled with the machine embodying the invention.
Figure 6:
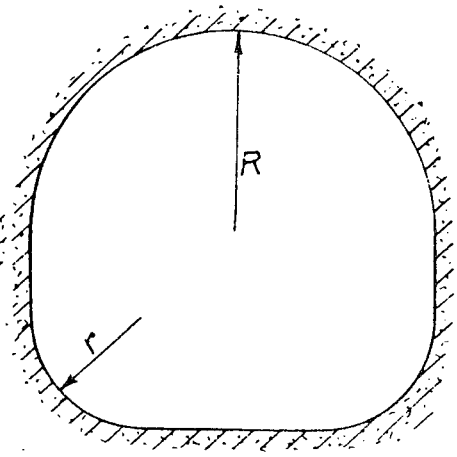
Figure 3:
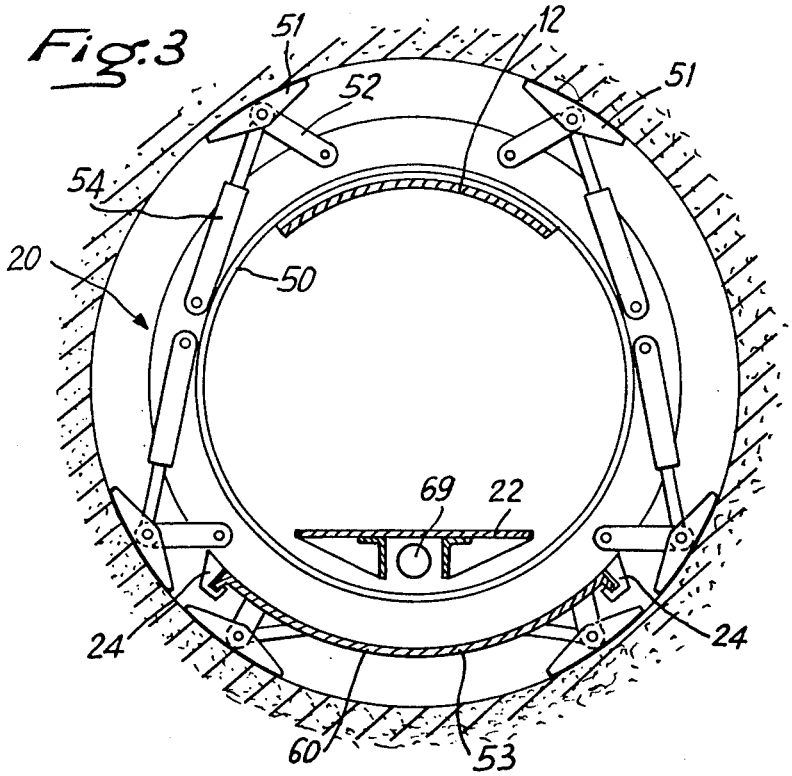
FIG. 3 is an end view from the left of the machine as shown in FIG. 1, with the cutting tool removed.
Figure 4:
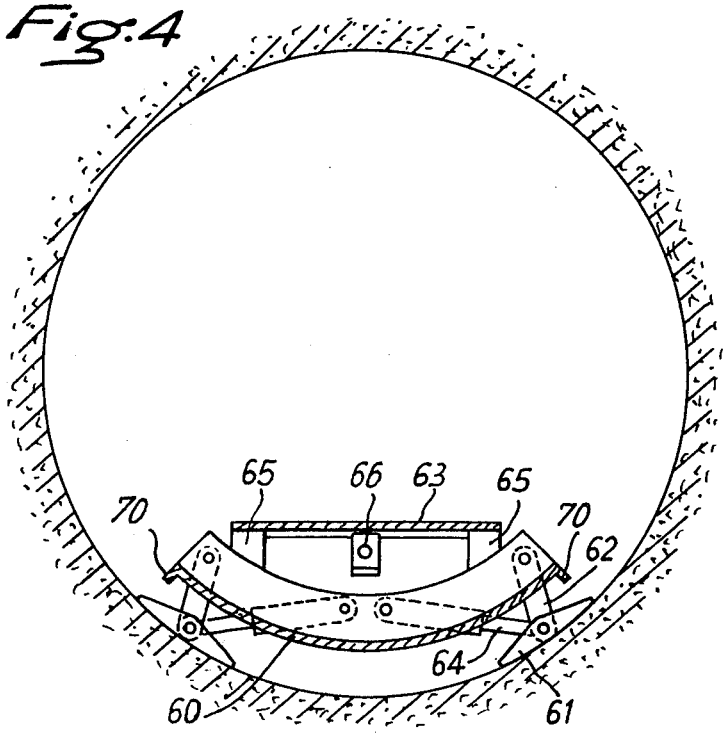
FIG. 4 is an end view from the left corresponding to FIG. 3 of the cradle support of the machine viewed in section along the line IV—IV in FIG. 1.

The present invention also contemplates sections of variable curvature such as ellipses or sections with two different radii R and *r* as illustrated in FIGS. 5 and 6. In such arrangements the curvature of the undercutting or grooving tool-carrying carriage 12 need be that of the larger radius. It will also be possible to provide a variant of the FIG. 6 tunnel in which the radius *r* is zero, in which two cutting carriages will be utilized, one for the vault or roof and the other for the walls.

What I claim is:

1. A channelling machine for cutting a preliminary groove or cut around the working face of a tunnel being excavated, said channelling machine comprising a tool suport for carrying a cutting tool projecting forwardly therefrom, a continuous guide and drive track assembly, a carriage mounted for orbital movement on and within said continuous guide and drive track assembly along the entire peripheral contour of the tunnel being cut, said continuous guide and drive track assembly including at least two radially inwardly disposed guide rails and at least one radially inwardly disposed drive rail, guide rollers mounted on said carriage and engaged for movement along the guide rails of said guide and drive track assembly, and a hollow support frame of cross section similar to that of the tunnel being cut, said guide and drive track assembly being fixed with respect to and confined entirely inside said support frame, said guide and drive track assembly including a back-up rail radially inwardly spaced from said support frame and associated with the one of said guide rails located in the vicinity of the front end of said support frame for receiving said guide rollers therebetween.

2. A machine according to claim 1, wherein said support frame also comprises, at its rear, means for supporting and securing other tools from the inside.

3. A machine according to claim 2, wherein said means for supporting and securing other tools comprises another guide and drive track assembly.

4. A machine according to claim 3, wherein said guide and drive track assemblies are disposed in symmetrical relationship to each other.

5. A machine according to claim 1, wherein said tool support is provided with self-propelling friction drive means including clamping jaws cooperable with said drive rail.

6. A machine according to claim 1, together with means for bracing said machine against walls of the tunnel.

7. A machine according to claim 6, together with means for adjusting the alignment of said machine in the tunnel.

8. A machine according to claim 7, wherein said means for bracing said machine and said means for adjusting the alignment of said machine comprise at least three independently adjustable, forward, bracing hydraulic cylinders.

9. A machine according to claim 1, together with means for effecting forward and reverse motion of said machine.

10. A machine according to claim 9, wherein said last mentioned means comprises a cradle mounted for forward and reverse displacement, said machine being fitted on said cradle for displacement thereon.

11. A machine according to claim 1, wherein a back-up rail is associated with each of said guide rails, said guide rollers being received between associated pairs of said guide rails and back-up rails.

12. A machine according to claim 11, wherein axes of said guide rollers are disposed substantially parallel to the longitudinal axis of said support frame.

* * * * *